US008650829B2

(12) United States Patent
Clarke et al.

(10) Patent No.: US 8,650,829 B2
(45) Date of Patent: Feb. 18, 2014

(54) DRYWALL REPAIR PROP SYSTEM

(76) Inventors: H. Bushnell Clarke, St Petersburg, FL (US); Susan J. Clarke, St Petersburg, FL (US)

( * ) Notice: Subject to any disclaimer, the term of this patent is extended or adjusted under 35 U.S.C. 154(b) by 508 days.

(21) Appl. No.: 12/807,718

(22) Filed: Sep. 13, 2010

(65) Prior Publication Data

US 2012/0060439 A1 Mar. 15, 2012

(51) Int. Cl.
*E04G 23/02* (2006.01)

(52) U.S. Cl.
CPC ..... *E04G 23/0203* (2013.01)
USPC ..... 52/741.1; 52/514

(58) Field of Classification Search
USPC ..... 52/127.7, 291, 514, 741.1, 741.4
See application file for complete search history.

(56) References Cited

U.S. PATENT DOCUMENTS

| | | | | |
|---|---|---|---|---|
| 3,690,084 | A * | 9/1972 | Leblanc | 52/514 |
| 4,945,700 | A * | 8/1990 | Powell | 52/514 |
| 2011/0277412 | A1 * | 11/2011 | Karam et al. | 52/514 |

* cited by examiner

*Primary Examiner* — Mark Wendell
*Assistant Examiner* — Matthew J Smith

(57) ABSTRACT

A prop assembly has interior and exterior members. Each member includes a plate with distal and proximal surfaces and attachment components on the distal surface of the interior member. The distal surface of the interior member is adapted to be secured to a support surface. The interior member includes a cylindrical tube with threads. The exterior member includes a cylindrical tube with threads. The threads of the tubes are rotatable with respect to each other. In this manner the distance between the distal surfaces is adjusted.

1 Claim, 4 Drawing Sheets

DRYWALL REPAIR PROP SYSTEM

BACKGROUND OF THE INVENTION

Field of the Invention

The present invention relates to a drywall repair prop system and more particularly pertains to filling a damaged area of drywall and providing a smooth drywall surface, the filling and providing being done in a safe, convenient, simplified and economical manner.

SUMMARY OF THE INVENTION

In view of the disadvantages inherent in the known types of drywall systems of known designs and configurations now present in the prior art, the present invention provides an improved drywall repair prop system. As such, the general purpose of the present invention, which will be described subsequently in greater detail, is to provide a new and improved drywall repair prop system and method which has all the advantages of the prior art and none of the disadvantages.

To attain this, the present invention essentially comprises a drywall repair prop system. First provided is a support surface. The support surface is positioned in a vertical orientation. The support surface is fabricated of a rigid material. The support surface provides a recipient region. In this manner the patching and repairing of an adjacent damaged drywall is facilitated.

Drywall is provided. The drywall has an interior surface. The drywall has an exterior surface. The interior and exterior surfaces are provided parallel with respect to each other. The interior and exterior surfaces are provided parallel with the support surface. The drywall has a hole. The hole is provided in an irregular shape, such as a trapezoid for example. The hole has a peripheral size. The hole is adapted to be patched. In this manner a smooth and continuous surface is provided to the damaged drywall.

Provided next is a patch component. The patch component has an interior surface. The patch component has an exterior surface. The patch component is fabricated of a drywall material. The drywall material of the patch component is the same as the drywall material of the exterior drywall. The patch component has a shape. The shape of the patch component is congruent with the shape of the drywall hole. The patch component has a peripheral size. The peripheral size of the patch component is less than the periphery of the hole in the drywall.

Further provided is a prop assembly. The prop assembly has an interior member. The prop assembly has an exterior member. The interior member includes a first circular plate. The first circular plate has a first distal surface. The first circular plate has a first proximal surface. The first distal surface has a first adhesive coating. The first adhesive coating has a first removable peel strip. The first peel strip is adapted to be removed from the first adhesive coating. The first distal surface and the first adhesive coating are adapted to be secured to the support surface at a location laterally offset from the hole. The interior member includes a hollow cylindrical tube. The hollow cylindrical tube has a first end. The first end of the hollow cylindrical tube is attached to the first proximal surface. The hollow cylindrical tube has a second end. The second end of the hollow cylindrical tube has internal threads.

The exterior member includes a second circular plate. The second circular plate has a second distal surface. The second circular plate has a second proximal surface. The second distal surface is adapted to be in contact with the interior surface of the patch component. The exterior member includes a rotatable tube. The rotatable tube has a first end. The first end of the rotatable tube is attached to the second proximal surface. The rotatable tube has a second end. The second end of the rotatable tube has external threads. The external threads are positionable within the hollow cylindrical tube. In this manner the distance between the first and second distal surfaces may be adjusted prior to positioning the second distal surface in contact with the patch component. In this manner the patch component will be in a plane with the drywall.

Provided last is spackling compound. The spackling compound is positioned between the patch component and the drywall. The spackling compound is smoothed into a plane of the exterior surface of the drywall and the exterior surface of the patch component. A tape covers the spackling compound as well as the exterior surfaces of the drywall and the patch.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved drywall repair prop system which has all of the advantages of the prior art drywall systems of known designs and configurations and none of the disadvantages.

It is another object of the present invention to provide a new and improved drywall repair prop system which may be easily and efficiently manufactured and marketed.

It is a further object of the invention to provide drywall repair devices which include, but not limited, infinitesimal adjustments, incremental adjustments, spring loaded mechanisms or multi layer devices to create counter pressure on the back of drywall patch for repair work to keep it flush in place.

It is a further object of the invention to provide drywall repair props which eliminate the need to find a wall stud or cut and hammer in a stud segment to support a patch piece.

It is a further object of the invention to provide a dry wall repair system featuring quicker and easier alignment of components wherein the drywall and patch components are of different thicknesses.

It is further object of the present invention to provide a new and improved drywall repair prop system which is of durable and reliable constructions.

An even further object of the present invention is to provide a new and improved drywall repair prop system which is susceptible of a low cost of manufacture with regard to both materials and labor, and which accordingly is then susceptible of low prices of sale to the consuming public, thereby making such drywall repair prop system economically available to the buying public.

Even still another object of the present invention is to provide a drywall repair prop system for filling a damaged area of drywall and providing a smooth drywall surface, the filling and providing being done in a safe, convenient, simplified and economical manner.

Lastly, it is an object of the present invention to provide a new and improved drywall repair prop system. A prop assembly has interior and exterior members. Each member includes a plate with distal and proximal surfaces and attachment components on the distal surface of the interior member. The distal surface of the interior member is adapted to be secured to a support surface. The interior member includes a cylindrical tube with threads. The exterior member includes a cylindrical tube with threads. The threads of the tubes are rotatable with respect to each other. In this manner the distance between the distal surfaces is adjusted.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
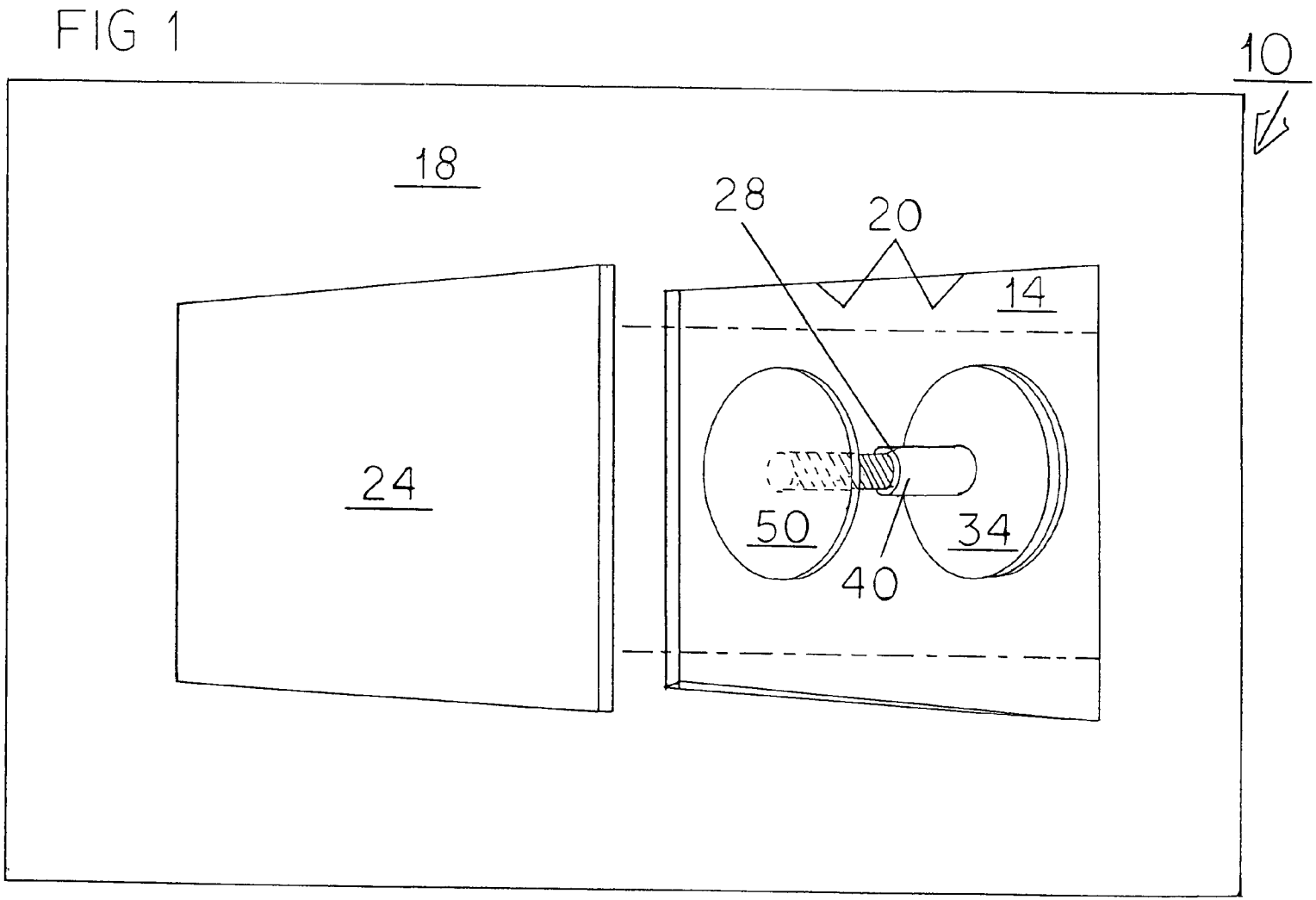
FIG. 1 is a perspective illustration of a drywall repair prop system constructed in accordance with the principles of the present invention.
Figure 2:
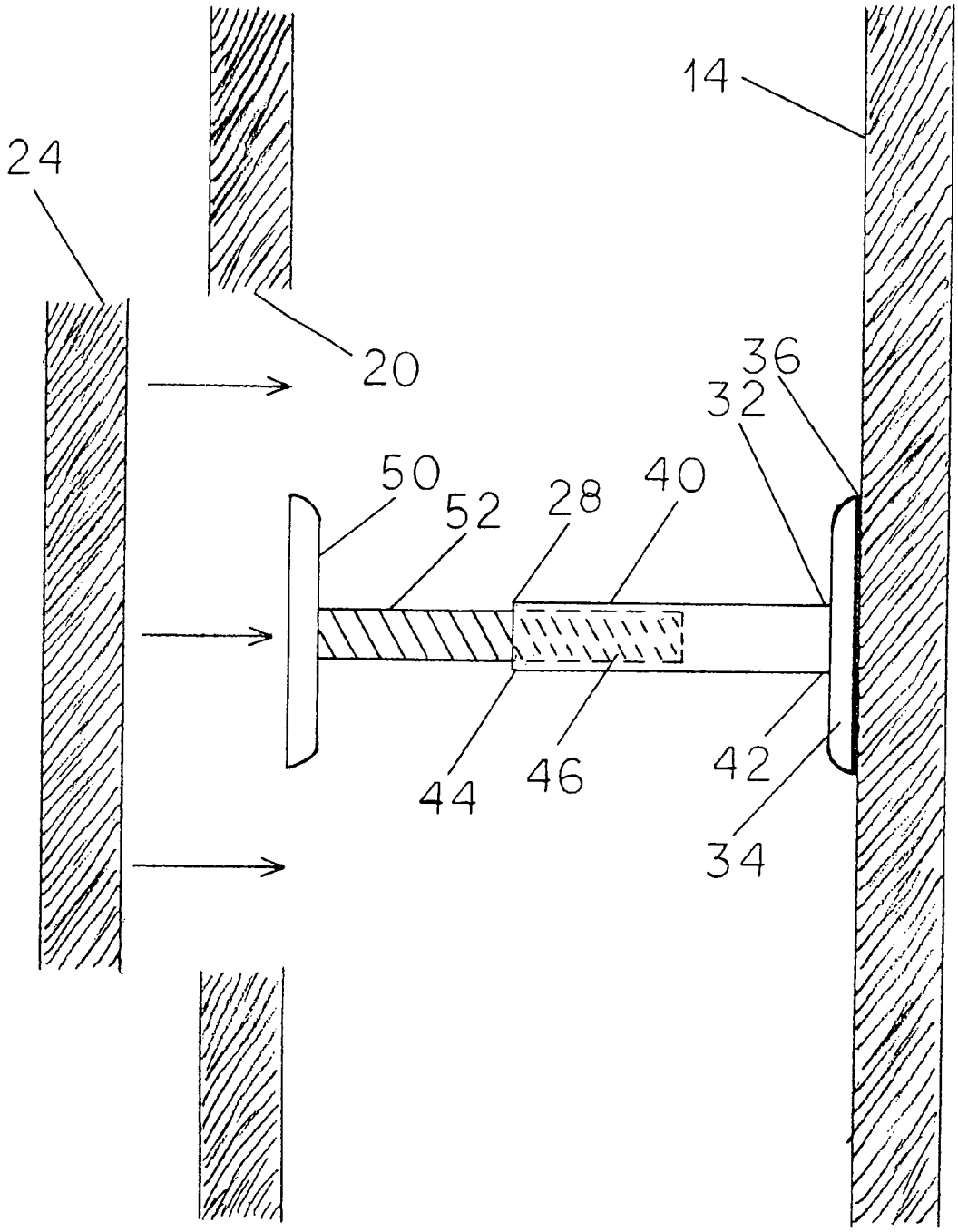
FIG. 2 is a side elevational view partly in cross-section of the system shown in FIG. 1.
Figure 3:
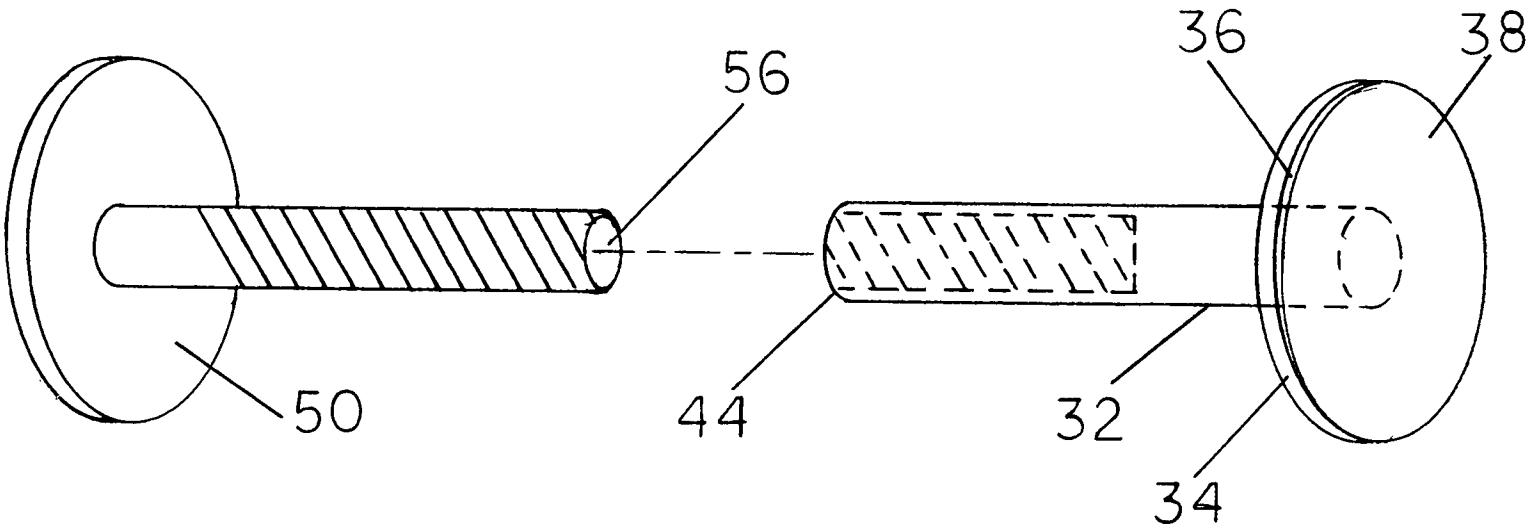
FIG. 3 is a side elevational view partly in cross-section of the system after installation.
Figure 4:
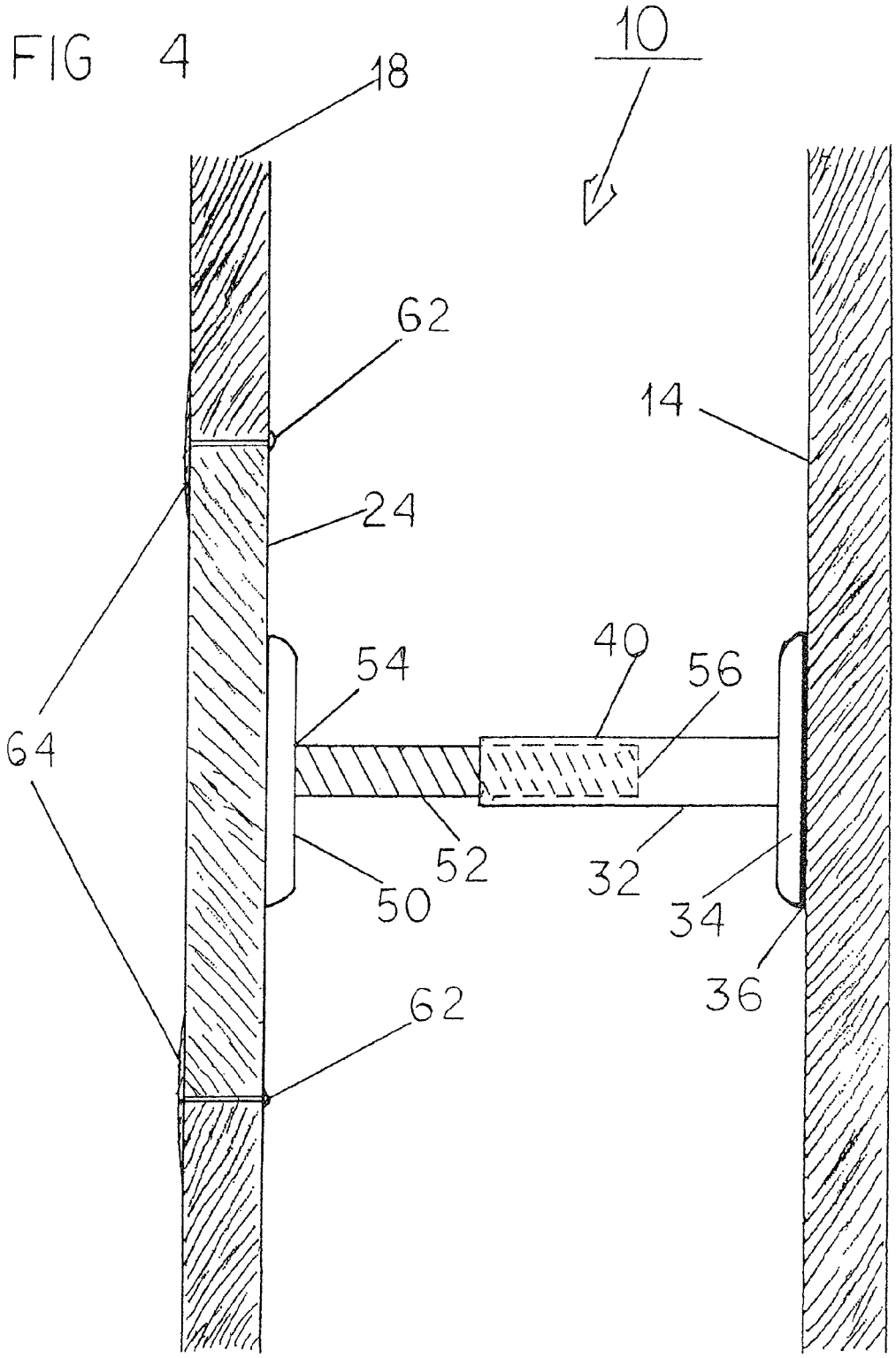
FIG. 4 is an exploded perspective view of the adjustable prop shown in FIGS. 1 through 3.

With reference now to the drawings, and in particular to FIG. 1 thereof, the preferred embodiment of the new and improved drywall repair prop system embodying the principles and concepts of the present invention and generally designated by the reference numeral 10 will be described.

The present invention, the drywall repair prop system 10 is comprised of a plurality of components. Such components in their broadest context include a prop assembly with internal and external members. Such components are individually configured and correlated with respect to each other so as to attain the desired objective.

First provided is a support surface 14. The support surface is positioned in a vertical orientation. The support surface is fabricated of a rigid material. The support surface provides a recipient region. In this manner the patching and repairing of an adjacent damaged drywall is facilitated.

Drywall 18 is provided. The drywall has an interior surface. The drywall has an exterior surface. The interior and exterior surfaces are provided parallel with respect to each other. The interior and exterior surfaces are provided parallel with the support surface. The drywall has a hole 20. The hole is provided in an irregular shape, such as a trapezoid for example. The hole has a peripheral size. The hole is adapted to be patched. In this manner a smooth and continuous surface is provided to the damaged drywall.

Provided next is a patch component 24. The patch component has an interior surface. The patch component has an exterior surface. The patch component is fabricated of a drywall material. The drywall material of the patch component is the same as the drywall material of the exterior drywall. The patch component has a shape. The shape of the patch component is congruent with the shape of the drywall hole. The patch component has a peripheral size. The peripheral size of the patch component is less than the periphery of the hole in the drywall.

Further provided is a prop assembly 28. The prop assembly has an interior member 30. The prop assembly has an exterior member 32. The interior member includes a first circular plate 34. The first circular plate has a first distal surface. The first circular plate has a first proximal surface. The first distal surface has a first adhesive coating 36. The first adhesive coating has a first removable peel strip 38. The first peel strip is adapted to be removed from the first adhesive coating. The first distal surface and the first adhesive coating are adapted to be secured to the support surface at a location laterally offset from the hole. The interior member includes a hollow cylindrical tube 40. The hollow cylindrical tube has a first end 42. The first end of the hollow cylindrical tube is attached to the first proximal surface. The hollow cylindrical tube has a second end 44. The second end of the hollow cylindrical tube has internal threads 46.

The exterior member includes a second circular plate 50. The second circular plate has a second distal surface. The second circular plate has a second proximal surface. The second distal surface is adapted to be positioned in contact with the interior surface of the patch component. The exterior member includes a rotatable tube 52. The rotatable tube has a first end 54. The first end of the rotatable tube is attached to the second proximal surface. The rotatable tube has a second end 56. The second end of the rotatable tube has external threads 60. The external threads are positionable within the hollow cylindrical tube. In this manner the distance between the first and second distal surfaces may be adjusted prior to positioning the second distal surface in contact with the patch component. In this manner the patch component will be in a plane with the drywall.

Provided last is spackling compound 62. The spackling compound is positioned between the patch component and the drywall. The spackling compound is smoothed into a plane of the exterior surface of the drywall and the exterior surface of the patch component. A tape 64 covers the spackling compound as well as the exterior surfaces of the drywall and the patch. In lieu of tape, some repairers leave a margin of the paper approximately 2 inches around the perimeter paper coating on the patch component 24 of the dry wall at its exterior surface. This is an alternative method of preparing the patch component.

In summary, when patching a hole in drywall, the patch component 24, is often pushed out of a flush position during the exterior finishing work of taping, spackling and texturing thereby creating more problems. The system of the present invention, when assembled and put in place, keeps the patch component 24 flush with the intact surface of the drywall 18 by using counter pressure from the interior surface of the back wall/support surface 14 by not allowing the patch piece to depress into the wall space during the exterior finishing work of taping, spackling and texturing, etc. of the exterior surface of the patch piece.

Interior member 30 attaches to a parallel surface. For the exterior member 50, it could have a fixed position parallel to member 34 or a spherical head allowing for repair to a wall not distinctly parallel to the back wall/support member 14.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A drywall repair prop method for filling a damaged area of drywall and providing a smooth drywall surface, the method comprising, in combination:

providing a support surface (14), the support surface being positioned in a vertical orientation, the support surface being fabricated of a rigid material, the support surface providing a recipient region to facilitate the patching and repairing of an adjacent damaged drywall;

providing a drywall (18) having an interior surface and an exterior surface, the interior and exterior surfaces being parallel with respect to each other and parallel with the support surface, the drywall having a hole (20) in an irregular shape, the hole having a peripheral size, the hole adapted to be patched for providing a smooth and continuous surface to the damaged drywall;

providing a patch component (24) having an interior surface and an exterior surface, the patch component being fabricated of a drywall material the same as the exterior drywall, the patch component having a shape congruent with the shape of the drywall hole, the patch component having a peripheral size less than the periphery of the hole in the drywall;

providing a prop assembly (28) having an interior member (30) and an exterior member (32), the interior member including a first circular plate (34), the first circular plate having a smooth first distal surface and a first proximal surface, coating a first adhesive (36) on the first distal surface and positioning a first removable peel strip (38) overlying the first adhesive coating, removing the first peel strip from the first adhesive coating, securing the first distal surface and the first adhesive coating to the support surface at a location laterally offset from the hole leaving the support surface imperforate, the interior member including a hollow cylindrical tube (40) with a first end (42) attached to the first proximal surface, the hollow cylindrical tube having a second end (44) with internal threads (46), the first distal surface having a diameter greater than the diameter of the hollow cylindrical tube;

the exterior member including a second circular plate (50), the second circular plate having a second distal surface and a second proximal surface, the second distal surface being smooth and adhesive free and planar, the second distal surface being positioned in sliding contact with the interior surface of the patch component leaving the interior surface of the patch component imperforate, the exterior member including a rotatable tube (52) with a first end (54) attached to the second proximal surface, the rotatable tube having a second end (56) with external threads (58) positionable within the hollow cylindrical tube to adjust the distance between the first and second distal surfaces prior to positioning the second distal surface in contact with the patch component whereby the patch component will be in a plane with the drywall, the second distal surface having a diameter greater than the diameter of the rotatable tube;

sliding the patch component on the distal surface of the second circular plate to facilitate proper positioning of the patch component within the hole; and positioning spackling compound (62) between the patch component and the drywall, smoothing the spackling compound into a plane of the exterior surface of the drywall and the exterior surface of the patch component, covering with a tape (64) the spackling compound as well as the exterior surfaces of the drywall and the patch.

* * * * *